US005127631A

United States Patent [19]

Flaig

[11] Patent Number: 5,127,631

[45] Date of Patent: Jul. 7, 1992

[54] CHAIN HOIST WITH INTEGRAL SAFETY DEVICE

[75] Inventor: Heinz Flaig, Bochum, Fed. Rep. of Germany

[73] Assignee: Mannesmann Aktiengesellschaft, Dusseldorf, Fed. Rep. of Germany

[21] Appl. No.: 500,374

[22] Filed: Mar. 28, 1990

[30] Foreign Application Priority Data

Mar. 28, 1989 [DE] Fed. Rep. of Germany ..... 3910369

[51] Int. Cl.[5] ..... B66D 5/04

[52] U.S. Cl. ..... 254/267; 182/239

[58] Field of Search ..... 254/378, 267; 182/239

[56] References Cited

U.S. PATENT DOCUMENTS

| | | | |
|---|---|---|---|
| 2,663,386 | 12/1953 | Fenley | 254/267 |
| 4,254,941 | 3/1981 | Tanson | 254/267 |
| 4,461,460 | 7/1984 | Telford | 254/378 |
| 4,463,933 | 8/1984 | Schreyer et al. | 254/378 |
| 4,511,123 | 4/1985 | Ostrobrod | 254/378 |
| 4,520,998 | 6/1985 | Flaig | 254/267 |
| 4,846,313 | 7/1989 | Sharp | 254/267 |

FOREIGN PATENT DOCUMENTS

| | | | |
|---|---|---|---|
| 544763 | 7/1932 | Fed. Rep. of Germany | 254/267 |
| 2534717 | 2/1977 | Fed. Rep. of Germany | 254/267 |
| 2801659 | 7/1979 | Fed. Rep. of Germany | 254/378 |
| 998279 | 2/1983 | U.S.S.R. | 254/267 |

*Primary Examiner*—Katherine Matecki

*Attorney, Agent, or Firm*—Cohen, Pontani, Lieberman, Pavane

[57] ABSTRACT

A chain hoist for supporting and selectively raising and lowering a load includes a powered gearwheel that is connected through a frictional lock with one or more friction disks fixed for rotation with the hoist drive shaft so as to provide a slip clutch arrangement. The hoist additionally includes, between one of the friction disks and a pressure spring, a safety brake disk for rapidly halting movement of the load in the event that the rotation of the brake disk attains or exceeds a predetermined speed or rate deemed to be excessive. For this purpose, the brake disk carries a detent pawl that is pivotally displaced by centrifugal force and into engagement with a detent nose or projection defined on the hoist housing when the brake disk rotation exceeds the predetermined speed.

11 Claims, 2 Drawing Sheets

CHAIN HOIST WITH INTEGRAL SAFETY DEVICE

The present invention relates to a hoist incorporating an integral safety device.

BACKGROUND OF THE INVENTION

Chain hoists, today typically driven by associated electric motor drives, have long been used for the selective, power-driven lifting and lowering of loads comprised of a wide variety of objects and materials. In order to prevent unintended and undesired overloading of such hoists and protect them from structural damage should, for example, the load-engaging hook which is carried by the hoist become caught or entangled or snagged on a heavy or substantially immovable protruding obstacle, it is known to provide the hoist with a slip clutch such, for example, as is disclosed in Federal Republic of Germany Patent No. 3,525,665. It is also known to equip a hoist with a centrifugal brake and detent pawls which, when a rotatable part of the hoist reaches or exceeds a predetermined speed of rotation deemed to be excessive, are driven by centrifugal force in opposition to the urgency of springs into engagement with detent noses or projections so as to effect extremely rapid braking of the hoist. Slip clutches and centrifugal brakes have, however, heretofore been separately utilized with hoists, have been so utilized to only a limited extent—most particularly in conjunction with relatively small hoists—and are expensive to implement.

Because of the possibility of injury to persons, structures or objects on unintended or accidental falling or other unusually rapid descents of hoist-carried loads, the operational dependability of hoists is a matter of great importance. Significantly, the structural and operational safety of hoists is a function not only of the care and design specifications provided by the manufacturer but, in addition, of the quality of user maintenance carried out both preventatively and in response to specific problems that arise in the course of their use. Thus, deficient or improper maintenance of an operative brake or slip clutch in a hoist can result in the required frictional moments being insufficient to accommodate an emergency situation whereby the load can no longer be supported and/or controlled.

SUMMARY OF THE INVENTION

It is accordingly the desideratum of the present invention to provide a safety device for a chain hoist, which safety device combines the functions of both a slip clutch and a centrifugal brake in an integrated, cost-effective and commercially-feasible manner constructed so as to take up only a relatively small amount of space and, thereby, without significantly increasing the overall size of the hoist.

These and other objects of the invention are achieved by providing in a hoist, between a moment-limiting slip clutch and an associated pressure spring, a safety brake disk which carries a detent pawl normally maintained in its neutral or inactive position by a retaining spring. The pawl is mounted so as to be thrown or displaced, by centrifugal force, radially outwardly when the brake disk attains or exceeds a predetermined excessive speed of rotation, whereby rotation of the brake disk is brought to a substantially immediate halt through engagement of the detent pawl with a detent nose or projection defined on the hoist housing. Although the safety brake disk is brought to a rapid stop through engagement of the detent pawl and housing nose, motion—typically descending movement—of the load carried by the hoist is gently and gradually braked through the action of a structurally and operationally-associated slip clutch that functions in the manner of a frictional lock.

In accordance with the invention, the power-driven hoist gearwheel is preferably arranged between opposed friction disks that are provided with friction linings and annular shoulders, the annular shoulders having cutouts for receiving a feather through which the gearwheel is fixed to and for rotation with the drive shaft of the hoist. Typically, the load carried by the hoist is supported on a chain or the like which is secured or connected to or otherwise associated with the drive shaft for lifting and lowering of the load through selective rotation of the drive shaft. The safety brake disk, carrying a friction lining for surface-to-surface engagement with one of the friction disks, is disposed between the slip clutch and a Belleville or other pressure-asserting spring, the Belleville spring being maintained in pressing relation against the slip clutch by way of a pressing ring and a nut threaded onto the drive shaft. The brake disk carries a detent pawl rotatably mounted thereto by a bolt and normally maintained in its disengaged or nonbraking or inactive position by a spring. In order to enable rapid response of the safety brake arrangement to the predetermined excessive rotational speed of the brake disk, the hoist housing is preferably provided with a plurality of detent noses or projections defined on and distributed about the interior circumference of the housing.

The safety brake assembly of the invention, as thus far described, can be further supplemented by the provision of an electrically-operated disconnect for preventing further operation of the hoist drive in its load-lowering direction of operation when the pawl is displaced by centrifugal forces generated as the brake disk reaches or exceeds the predetermined rotational speed. In this manner, a user is unable to thereafter apply operating power to the hoist to lower the load against the action of the engaged safety brake which, as should be apparent, could otherwise result in thermal overloading of and consequent damage to the brake and/or hoist mechanism.

A particular advantage of the present invention is that the frictional moment of the safety brake so constructed need not be separately adjusted for accommodating different loads that are or are intended to be carried or supported by the hoist. That is, appropriate adjustment of the slip clutch also provides a suitable adjustment of the safety brake of the inventive hoist assembly.

Futhermore, in a preferred form of the inventive hoist the load can still be reliably braked both in the event of a total failure of the motor brake and in the event of a decrease of slip-clutch moment to less than 40% of its normal frictional forces resulting from wear or deterioration of the friction linings.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
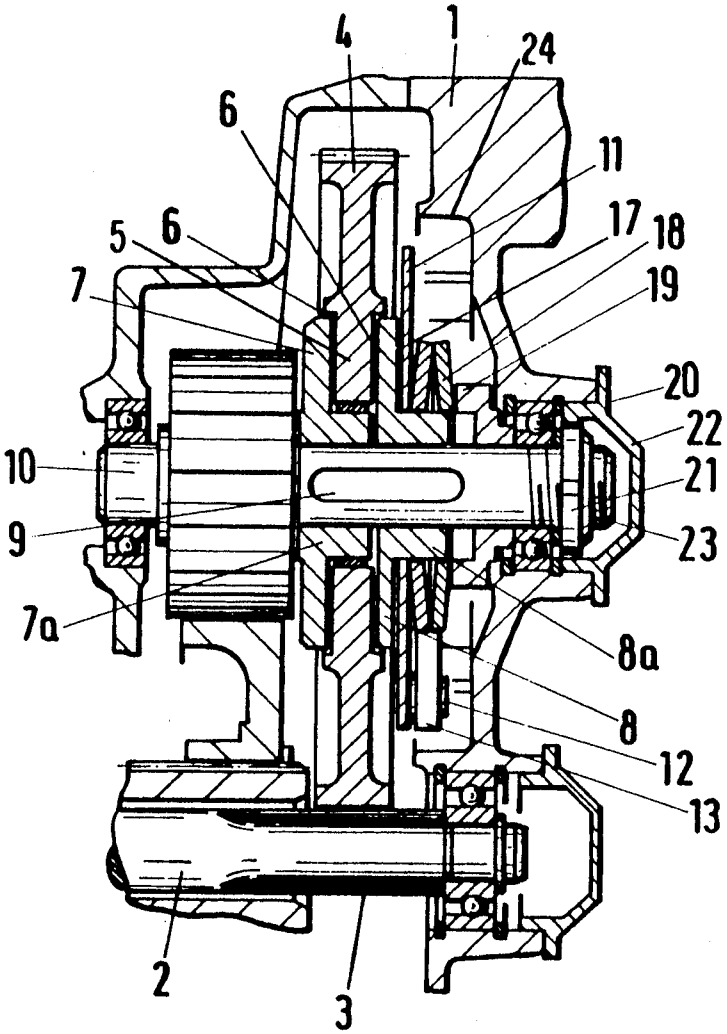
FIG. 1 is a cross-sectional side view of a hoist incorporating a safety device constructed in accordance with the present invention.

A chain hoist incorporating a safety device constructed in accordance with the teachings of the present invention is depicted in FIG. 1 of the drawings. Disposed within a housing 1 of the hoist is a drive shaft 2 which engages a gearwheel 4 by way of a pinion 3. The drive shaft is typically a part of or connected to an electric motor or the like (not shown), as is well known in the art, and is thereby rotationally driven or powered, its rotation being communicated and transferred to the gearwheel 4 by the pinion 3. The radially-inward or central portion 5 of the gearwheel 4 is positioned between an opposed pair of friction disks 7, 8 which carry friction linings 6 and include annular shoulders 7*a*, 8*a*, respectively. Cutouts defined in the friction disk shoulders 7*a*, 8*a* receive a feather 9 for rotatably fixing the disks 7, 8 to a drive shaft 10 for a sprocket wheel (not shown) of the chain hoist.

Figure 2:
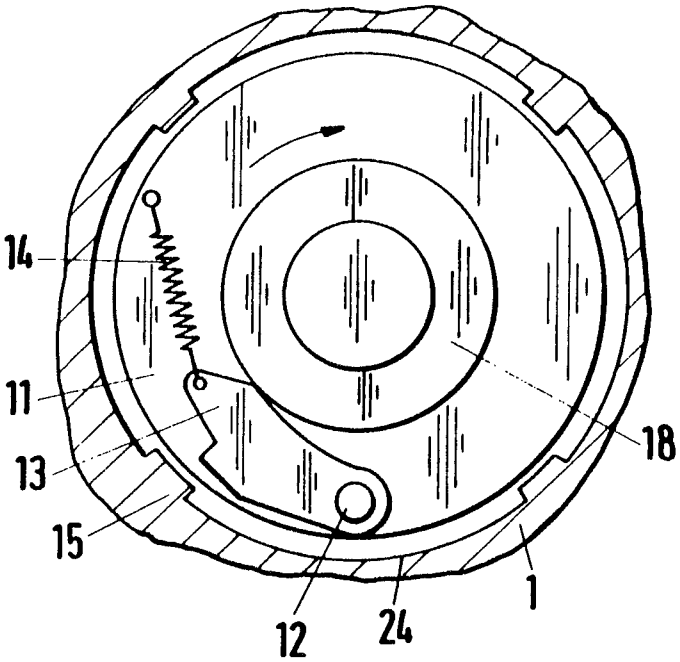
FIG. 2 is a rear face view of the safety device of FIG. 1.

The annular shoulder 8*a* radially-outwardly supports or carries a centrifugal force friction disk 11 to which a detent pawl 13 is mounted, at one end of the pawl, by and for pivotted rotation about a bolt 12. The opposite end of the pawl is connected to the disk 11 by a spring 14 which normally maintains the pawl in its unactivated or disengaged position seen in FIG. 2. When the disk 11 is rotated at or in excess of a predetermined speed deemed to be unusual or excessive, centrifugal forces acting on the pawl cause it to rotate or pivot about the bolt 12 whereby the pawl is displaced, against the restorative urgency of the spring 14, into abutting engagement with one of a plurality of detent noses or projections 15 defined in a substantially circular, generally central recess 24 of the hoist housing 1. Thus the friction disk 11, in conjunction with the associated pawl 13, functions as a safety brake disk to substantially immediately halt further rotation of the disk 11 when its rotative speed reaches or exceeds the predetermined rate.

The safety brake disk 11 abuts or engages, through an interposed friction lining 17 carried on the disk 11, the friction disk 8. The disks 7, 8 and 11 are clamped or pressed and maintained in surface-to-surface engagement by a pressure spring member 18—implemented, in the disclosed embodiment of the invention, in the form of Belleville springs—which is captured by a pressing ring 19, a support 20 and a nut 21 that engages a thread 23 of the drive shaft 10. The spring 18 is further secured axially in the housing 1 by snap rings 22 arranged on both sides of the support 20. The opposed friction disks 7, 8—in conjunction with the gearwheel 4 positioned therebetween—form and define a slip clutch that is effective against overloading of the hoist. As previously pointed out, the safety brake disk 11 is operative for rapidly braking downward or lowering movement of the hoist-supported load on engagement of the detent pawl 13 with one of the housing noses 15 in response to predeterminately excessive rotational speed of the disk 11.

Figure 3:
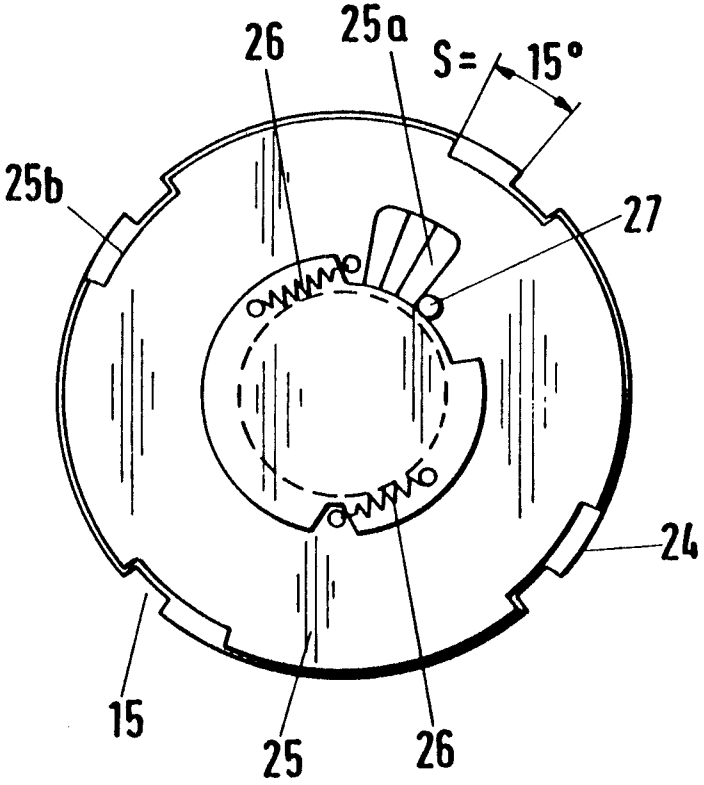
FIG. 3 is a rear face view of an electric disconnect assembly.
Figure 4:
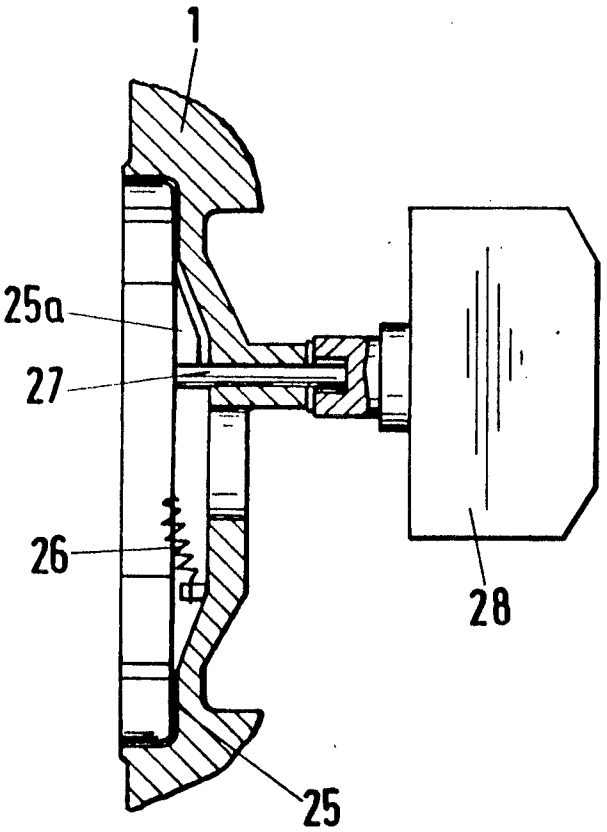
FIG. 4 is a cross-sectional side view of the electric disconnect assembly of FIG. 3.

FIGS. 3 and 4 illustrate the construction and operation of an electric disconnect feature for a chain hoist in accordance with the present invention. The electric disconnect is comprised of a thin-walled structural member 25 having the general form of a relatively flat cup. The thin-walled member or cup 25 is inserted into the housing recess 24 such that the cup fits with relatively little or closely-proximate radial clearance with the adjacent periphery of the housing recess 24 for rotative guidance of the cup 25 by the recess periphery. Indentations 25*b* defined in the outer wall of the cup 25, at locations generally corresponding to the placement of the detent noses 15, have a circumferentially-defined length which is greater than the circumferential length or extension of the noses 15. As a consequence, the inserted cup member 25 is rotatably moveable or displaceable about its axis and within the housing recess 24 through a switch path S of approximately 15°.

The cup member 25 is connected to the housing 1 by retaining springs 26 which normally positionally bias and urge the member 25 to its FIG. 3 position wherein the boundaries or edges of its indentations 25*b* abuttingly engage the rear flanks or edges of the intercept noses 15. As the centrifugal forces generated by rotation of the disk 11 cause radially-outward pivotal displacement of the detent pawl 13, the pawl 13 pushes or forces the cup member 25 before it through the switch path S until the indentations 25*b* abut the forward or working flanks or edges of the detent or noses 15. The presence of a ramp 25*a* defined on the bottom or underside of the cup member 25 causes this rotary movement of the cup to be converted into a lifting or axial displacement of a pushrod 27 supported in the housing wall 1 to thereby actuate a switch 28 disposed in an adjoining or associated electric housing. Actuation of the switch 28 results in, for example, electrical disconnection and disablement of the hoist-powering electric motor so as to prevent further load-lowering driven movement of the hoist components. By thereafter briefly lifting the load, the safety brake is disengaged, electrical operating power is return to the motor and the user can then once more operate the hoist to selectively lower or otherwise control the position of the load.

While there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of claims appended hereto.

What is claimed is:

1. A hoist operable for raising and lowering of a supported load and including an integral safety device, said hoist comprising:

a positionally-fixed housing (1);

a rotatably driven gearwheel (4) in said housing;

a rotatable drive shaft (10) in said housing;

a friction disk (8) fixed to and for rotation with said drive shaft and fictionally engaging said gearwheel (4) on one side of said gearwheel to define with said gearwheel a slip clutch for normally transferring said driven rotation of the gearwheel to a rotation of said drive shaft for raising and lowering of a load supported by said drive shaft;

a pressure spring (18) in said housing;

a detent nose (15) on said positionally-fixed housing;

a rotationally-disposed safety brake disk (11) interposed between said friction disk (8) and said pressure spring (18) and carrying a detent pawl (13), said detent pawl being pivotally mounted to said brake disk (11) so that the pawl is normally disposed in a first position and is pivotally displaced by centrifugal force to a second position when said brake disk rotates at or in excess of a predetermined speed, said detent pawl (13) being located on said brake disk so that, as the pawl is displaced form said first to said second position, it engages said positionally-fixed detent nose (15) on the hoist housing to immediately halt and prevent further rotation of said brake disk relative to the hoist housing when said brake disk rotation reaches or exceeds said predetermined speed;

said pressure spring (18) pressing said safety brake disk (11) into frictional engagement with said friction disk (8) so that said brake disk (11) is caused to rotate with said friction disk (8) as said friction disk rotates at less than said predetermined speed and so that, when said detent pawl (13) engages said positionally-fixed detent nose (15) to immediately halt and prevent further rotation of said brake disk (11) relative to the hoist housing, said frictional engagement of the brake disk and friction disk causes gradual rotational slowing of said friction disk and, correspondingly, of said drive shaft (10) until rotation of said friction disk and drive shaft is halted;

a second friction disk (7) disposed on an opposite side of the gearwheel from said friction disk (8) so that said gearwheel is positioned between said friction disk (8) and said second friction disk (7);

friction linings (6) on said friction disk (8) and said second friction disk (7) for frictional engagement with said gearwheel (4); and a brake disk friction lining (17) on said brake disk (11) for frictional engagement with said friction disk (8).

2. A hoist in accordance with claim 1, wherein said friction disks (7, 8) include annular shoulders (7*a*, 8*a*) having recesses for a feather (9) that extends into a groove defined in said drive shaft for fixing said friction disks to and for rotation with said drive shaft (10).

3. A hoist in accordance with claim 2, wherein said brake disk (11) is carried on said annular shoulder (8*a*) of said friction disk (8), said hoist further comprising a pressing ring (19) for positionally maintaining said pressure spring so as to urge said brake disk (11) into engagement with said friction disk (8), and a support (20) for positionally maintaining said pressing ring (19) and fixed to said drive shaft (10) by an adjustable nut (21) screwed onto a thread (23) of the drive shaft.

4. A hoist in accordance with claim 3, wherein said pressure spring (18) comprises a plurality of Belleville springs.

5. A hoist in accordance with claim 3, wherein said support (20) is axially secured in said housing (1) by snap rings (22).

6. A hoist in accordance with claim 5, wherein said housing (1) includes a housing recess (24), said hoist further comprising drive means (2) operable for effecting said driven rotation of the gearwheel (4), a cup-shaped member (25) carrying a ramped surface (25*a*), a pushrod (27) movably supported in said housing (1) for engagement with said ramped surface, a switch (28) operably connected to said pushrod, and a retaining spring (26) normally maintaining said member (25) in a first rotative position, said cup-shaped member being disposed in said housing recess for rotative movement by said detent pawl (13), through a predetermined angle, as said pawl moves from said first to said second position, whereby said pushrod (27) rides along said ramped surface (25*a*) and said pushrod is thereby moved to operate said switch (28) for disabling said drive means from effecting load-lowering operation of the hoist.

7. A hoist in accordance with claim 1, wherein said detent pawl (13) is pivotally mounted to said brake disk (11) by a bolt (12) and is normally maintained in said first position by a spring (14).

8. A hoist in accordance with claim 1, wherein said housing (1) includes a housing recess (24), further comprising a plurality of said detent noses (15) arranged circumferentially about said housing recess.

9. A hoist in accordance with claim 1, further comprising drive means (2) operable for effecting said driven rotation of the gearwheel (4), and disconnect means actuatable in response to said displacement of the detent pawl (13) from said first to said second position for disabling said drive means against load-lowering operation of the hoist.

10. A hoist in accordance with claim 9, wherein said housing (1) includes a housing recess (24), said disconnect means comprising a cup-shaped member (25) carrying a ramped surface (25*a*), a pushrod (27) movably supported in said housing (1) for engagement with said ramped surface, a switch (28) operably connected to said pushrod, and a retaining spring (26 normally maintaining said member (25) in a first rotative position, said cup-shaped member being disposed in said housing recess for rotative movement by said detent pawl (13), through a predetermined angle, as said pawl moves from said first to said second position, whereby said pushrod (2) rides along said ramped surface (25*a*) and said pushrod is thereby moved to operate said switch (28) for disabling said drive means from effecting load-lowering operation of the hoist.

11. A hoist in accordance with claim 1, wherein said housing (1) includes a housing recess (24), said hoist further comprising drive means (2) operable for effecting said driven rotation of the gearwheel (4), a cup-shaped member (25) carrying a ramped surface (25*a*), a pushrod (27) movably supported in said housing (1) for engagement with said ramped surface, a switch (28) operably connected to said pushrod, and a retaining spring (26) normally maintaining said member (25) in a first rotative position, said cup-shaped member being disposed in said housing recess for rotative movement by said detent pawl (13), through a predetermined angle, as said pawl moves from said first to said second position, whereby said pushrod (27) rides along said ramped surface (25*a*) and said pushrod is thereby moved to operate said switch (28) for disabling said drive means from effecting load-lowering operation of the hoist.

* * * * *